US006619371B1

(12) United States Patent
Lauper

(10) Patent No.: US 6,619,371 B1
(45) Date of Patent: Sep. 16, 2003

(54) METHOD AND DEVICE FOR CONTROLLING THE MOVEMENT OF THE TEEMING LADLE HAVING A LOW TEEMING HEIGHT IN A TEEMING INSTALLATION DEVICE

(75) Inventor: Fritz Lauper, Wiler bei Seedorf (CH)

(73) Assignee: Hubo Engineering GmbH, Wiler bei Seedorf (CH)

( * ) Notice: Subject to any disclaimer, the term of this patent is extended or adjusted under 35 U.S.C. 154(b) by 0 days.

(21) Appl. No.: 09/446,538

(22) PCT Filed: Jun. 17, 1998

(86) PCT No.: PCT/CH98/00261

§ 371 (c)(1),
(2), (4) Date: Dec. 27, 1999

(87) PCT Pub. No.: WO99/00205

PCT Pub. Date: Jan. 7, 1999

(30) Foreign Application Priority Data

Jun. 27, 1997 (CH) ..... 1554/97

(51) Int. Cl.[7] ..... B22D 39/00; B22D 41/06

(52) U.S. Cl. ..... 164/136; 164/335; 222/599; 222/590

(58) Field of Search ..... 266/236, 276, 266/240; 164/335, 438, 136, 336; 222/590, 599, 604, 605

(56) References Cited

U.S. PATENT DOCUMENTS

| | | | | | |
|---|---|---|---|---|---|
| 4,112,998 | A | * | 9/1978 | Sato | 164/136 |
| 4,155,400 | A | * | 5/1979 | Rosin et al. | 164/136 |
| 4,304,343 | A | * | 12/1981 | Bauer et al. | 222/604 |
| 5,170,915 | A | * | 12/1992 | Szadkowski | 222/600 |
| 5,381,855 | A | * | 1/1995 | Mezger | 164/457 |
| 5,758,714 | A | * | 6/1998 | Sato et al. | 164/457 |

FOREIGN PATENT DOCUMENTS

| | | | | |
|---|---|---|---|---|
| DE | 35 32 763 | | 3/1986 | B22D/35/04 |
| DE | 36 10 120 | | 4/1987 | B22D/47/00 |
| JP | 04190960 A | * | 7/1992 | |
| JP | 05069111 | | 3/1993 | B22D/39/00 |
| JP | 06007919 A | * | 1/1994 | |
| JP | 08141732 | * | 6/1996 | |

* cited by examiner

*Primary Examiner*—Kuang Y. Lin
*Assistant Examiner*—Kevin McHenry
(74) *Attorney, Agent, or Firm*—Karl Hormann

(57) ABSTRACT

During a casting operation a teeming ladle is moved relatively horizontally in the X direction and vertically in the Z direction and pivoted about rotational axis A. Thus it becomes possible during automatic casting always to maintain the theoretical fulcrum of the spout about which the teeming ladle is pivoted while maintaining a safety margin between the teeming ladle and the mold at the lowest possible position.

9 Claims, 2 Drawing Sheets

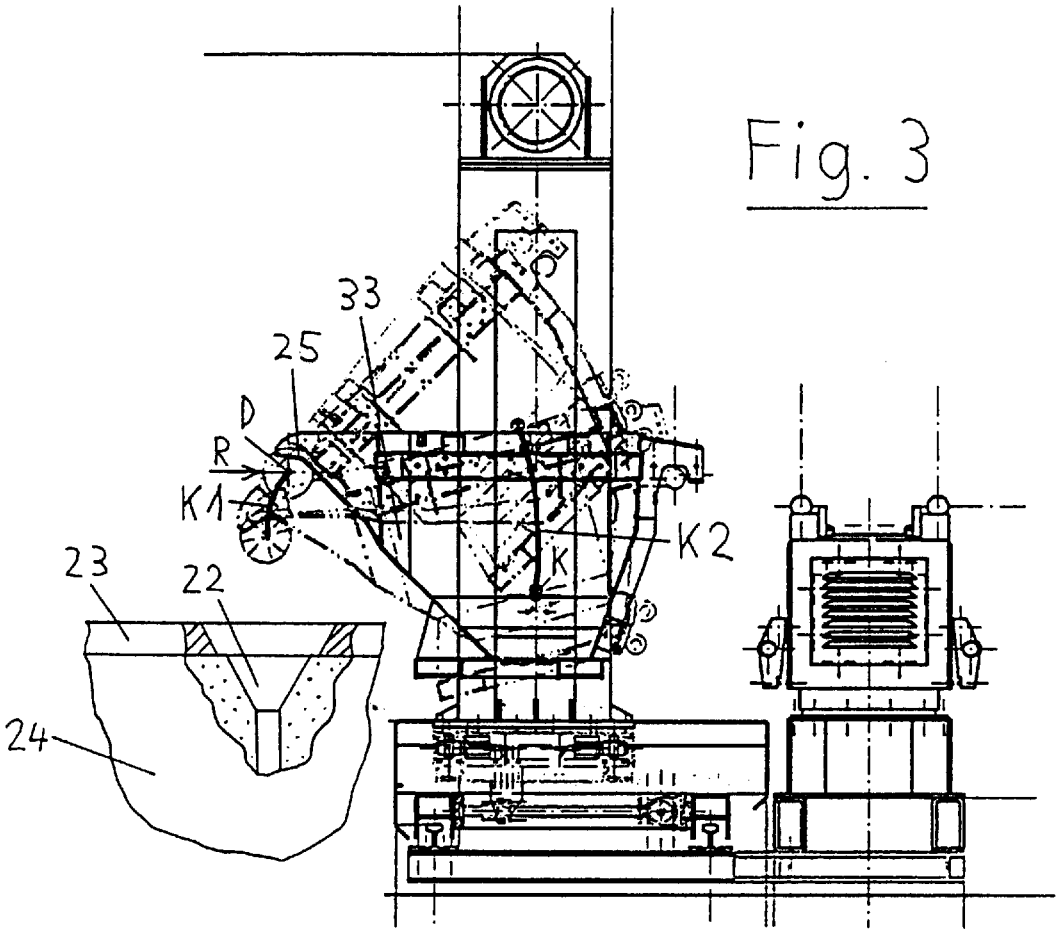
Fig. 3
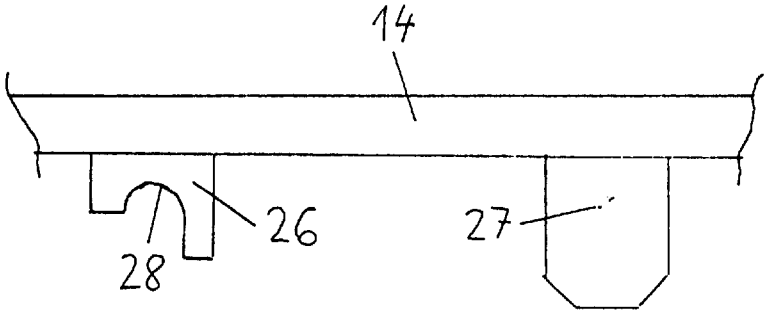
Fig. 4
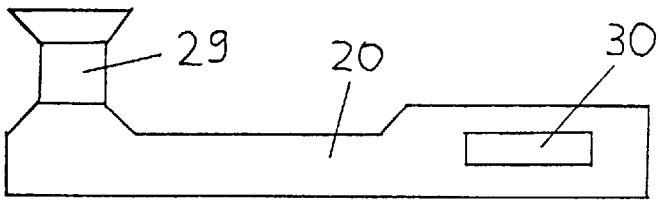

METHOD AND DEVICE FOR CONTROLLING THE MOVEMENT OF THE TEEMING LADLE HAVING A LOW TEEMING HEIGHT IN A TEEMING INSTALLATION DEVICE

BACKGROUND OF THE INVENTION

1. Field of the Invention

The present invention relates to a method of controlling the movement of a teeming ladle and to a teeming machine for carrying out the method.

Existing automatic foundry installations for the repeated controlled filling of liquid metals from a tiltable ladle into successively furnished moulds function in the following manner: the molten mass during the teeming runs via a spout stone of radius R out of the ladle, wherein the tilting axis of the ladle extends at least approximately through the centre of this radius, the so called theoretical point of rotation of the spout, such that independently of the tilting angle of the ladle approximately equal geometric and thus flow design relationships are to be achieved. The tilting is effected via a controlled drive which via mechanical connection members engages the ladle.

With such installations one achieves an excellent running of the teeming procedure when teeming, during the teeming and at the completion of this. However, such installations suffer from the disadvantage for teeming at a relatively low teeming height the teeming funnel must lie near the edge of the mould box. With teeming funnels positioned further inside and whilst maintaining the required defined safety distance of the ladle body with respect to the mould box, the teeming height increases because of the segment shape of the teeming ladle.

Since teeming funnels positioned far inside the mould box may not be reached in a satisfactory manner, the funnel must be pulled to the edge which with existing models leads to costly modifications. In moulding boxes with weighting iron, the weighting iron must often be modified which again leads to additional costs. However since on the models or weighting irons, changes may not always be carried out, on account of the high teeming height one may only teem with an extended teeming spout. Such a teeming spout is however not suitable for the automatic teeming and with manual teeming can be handled only with difficulty.

From EP Patent 592 365 there is known a teeming method in which the teeming ladle, after the first teeming operation, and because of a stationary tilting axis may be displayed further towards the middle of the teeming mould, whilst maintaining a certain safety distance of the teeming ladle with respect to the teeming box. With this method the stationary tilting axis with the lift drive is attached at the front on the teeming spout and since the tilting bearing required on the tilting axis must likewise be located at a safety distance over the teeming box or the weighting iron, this leads by way of design likewise to a large teeming height. A large teeming height however causes considerable disadvantages; since more kinetic energy must be destroyed a deeper teeming funnel becomes necessary so that the top box may not be optimally exploited. Furthermore more circulation material is required, there is more splatter iron, a more erratic teeming with more turbulence in the funnel, and more sand rinsings and more sand and gas enclosures are to be expected. With mould boxes with weighting iron the teeming height is increased further since the tilting bearing must lie above the weighting iron.

BRIEF SUMMARY OF THE INVENTION

It is thus an object of the invention to avoid all mentioned disadvantages and to provide a method and a teeming machine for controlling the movement of a teeming ladle, with which one may always teem at a lower teeming height even when the teeming funnels are arranged at any location in the mould box, and with which the theoretical point of rotation of the spout is stably guided into the lowest possible position. This object is achieved by the method and the teeming machine as hereinafter set forth in greater detail.

BRIEF DESCRIPTION OF THE DRAWINGS

Hereinafter, a preferred embodiment of the invention is described in more detail by way of the schematic drawings, in which:

FIG. 3 is a view of the teeming ladle in the teeming position and FIG. 4 is a sketched detail of the teeming ladle suspension.

DETAILED DESCRIPTION OF THE INVENTION

Figure 1:
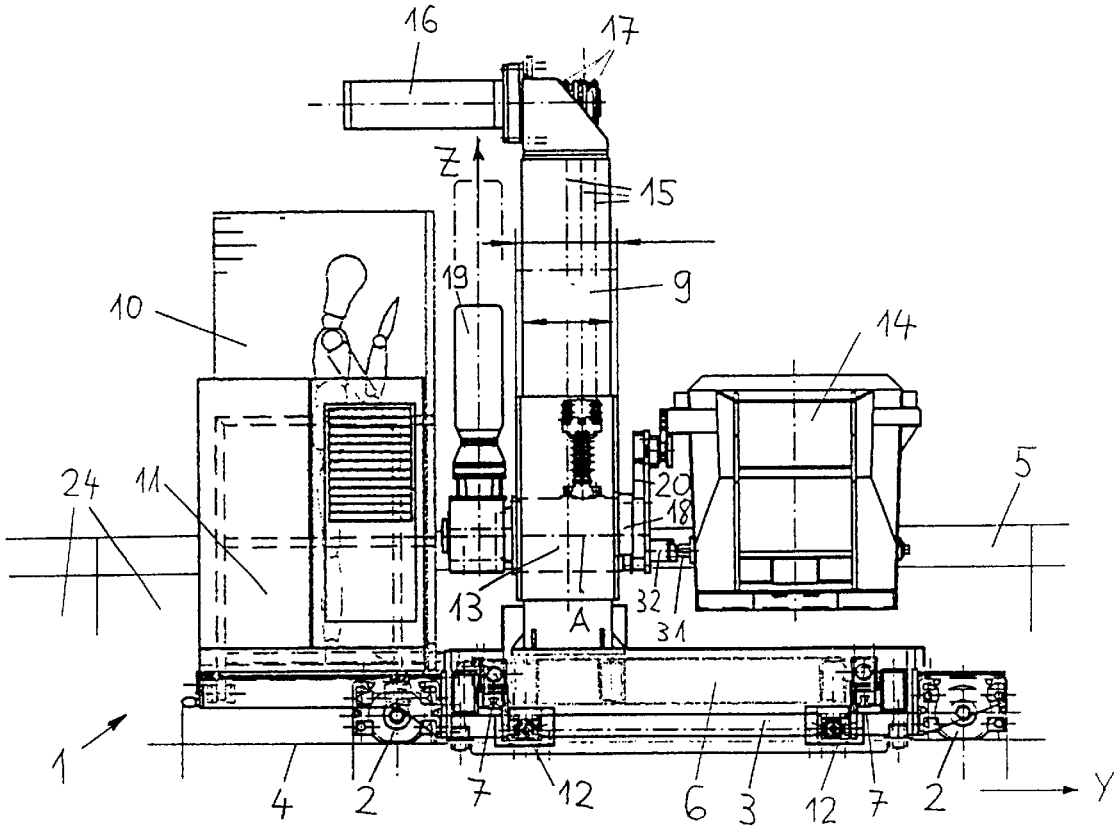
FIG. 1 is a side elevational view of the teeming machine
Figure 2:
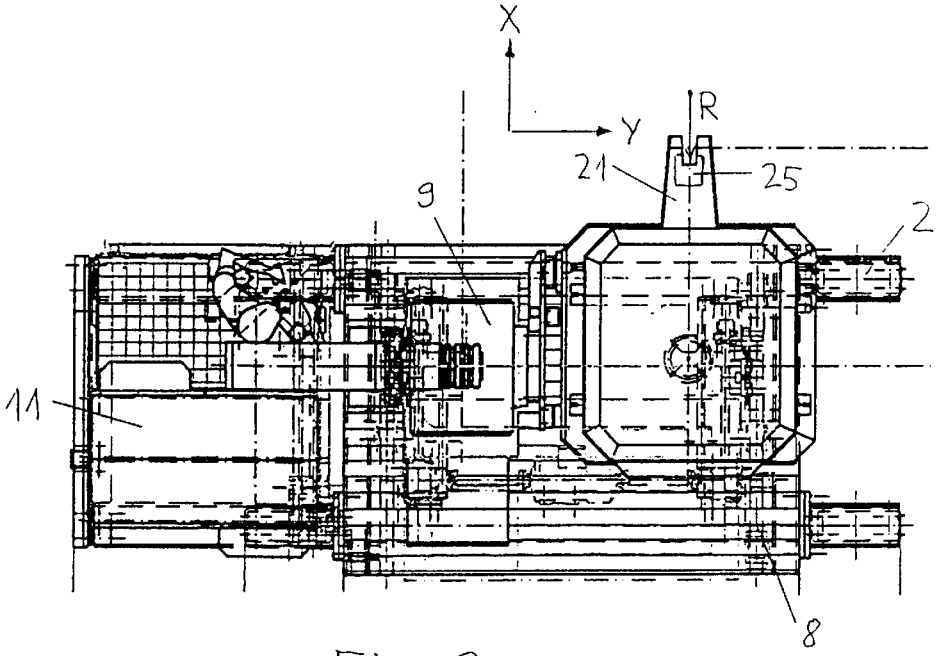
FIG. 2 is a top elevational view of the teeming machine shown in FIG. 1.

According to FIG. 1, the teeming machine 1 on wheels 2 of a longitudinal carriage 3 is horizontally movable on rails 4 in a direction Y, parallel to a teeming mould path indicated at 5. The longitudinal carriage 3 supports a transverse carriage 6, which by way of rail guides 7 is transversely displaceable in a direction X by way of a friction motor 8. On the transverse carriage 6 there is mounted a tower-like structure of the teeming machine and its control cabin 10 with the electronic control means 11, with an intermediate arrangement of pressure fluid gauge chambers 12. In the structure 9, there is provided a retaining means 13 for the teeming ladle 14 for moving it up and down in the vertical direction Z. The retaining means 13 is suspended on a chain 15 which is displaced via chain wheels 17 driven by a lift motor 16. In the retaining means 13 there is mounted a tilt shaft 18 which is rotatable about an axis A and which is driven by a tilt motor 19. The tilt shaft 18 pivots a protruding suspension plate 20 in which the teeming ladle 14 is suspendably fastened.

During operation of the teeming machine the longitudinal carriage 3 and the teeming ladle 14 filled with moulten metal mass is moved in the Y-direction until the teeming spout 21 at the height of the teeming funnel 22 is opposite the teeming mould 24 loaded with the weighting iron 23 and which is to be cast, which is effected by the electronic control means 11. The electronic control means 11 is provisionally programmed corresponding to the dimensions of the teeming moulds to be cast. According to the programm which is to be called up the friction motor 8, the lift motor 16 and the tilt motor 19 are controlled in a manner such that the theoretical point of rotation of the spout D with the radius R of the spout stone 25 moves on the curve K1 from above to below which always corresponds to the lowest possible teeming height whilst observing a safety distance. For this the engagement point K of the tilting moment transmitted by the tilt shaft 18 via the suspension plate 20 onto the teeming ladle 14 must move on the curve K2 correspondingly from bottom to top, which is effected by the suitable control of the mentioned motors.

By way of the pressure fluid gauge chambers 12 functioning as weighing cells the teeming procedure may be automatically stopped by the control means 11 in dependence on the cast molten mass weight and may be resumed with the subsequent teeming mould. With this the electronic control means is programmed such that the lifting and lowering of the teeming spout is carried out in the fast mode during the teeming pause which is to be kept as small as possible. Until the curves K1 and K2 are passed through and the teeming ladle is thus emptied, in general several teeming moulds may be filled. With empty teeming ladle the teeming machine must traverse to a loading and unloading station where the empty teeming ladle is replaced by one which is full. Thereupon after traversing back the teeming procedure may be reassumed. In order to avoid such a temporal interruption in teeming, two teeming machines may be arranged next to one another so that when the teeming ladle of the first teeming machine is empty the second immediately continues the teeming operation whilst the first one replaces the empty teeming ladle with a filled one. The only condition to this method is that the loading and unloading station can be reached in both directions of the rails 4.

With the protruding suspension plate 20 it is possible for the first time to fasten the teeming ladle only on one of its lateral surfaces and to tilt it. This is achieved with protruding coupling parts 26 and 27 on the teeming ladle, wherein the part 26 with a partially circular recess 28 engages into an axle stub 29 and the part 27 into an opening 30 of the retaining plate 20 by which means the teeming ladle is suspended to the retaining plate. For its lateral stabilisation the teeming ladle 14, with a rounded protrusion 31 below rests on a protruding part 32 of the suspension plate 20. With this suspension of the teeming ladle numerous advantages result, thus the teeming machine may be designed smaller, the accessibility between the teeming ladle and teeming mould is improved, only a vertical drive in the Z-direction and a tilting device about the axis A is necessary, a rotational drive for exchanging the ladle is made possible, by which means this exchange is greatly accelerated and ladles of varying size may be applied.

The spout 21 of the teeming plate 14 is equipped with an exchangeable spout stone 25. In this manner the stone may be kept smaller and more economical; it may be simply and quickly exchanged whenever a ladle is changed and fireproof material is saved. The exact insertion of the spout stone is effected by a bracket mounted on the snout so that the radius of the spout stone on teeming moves exactly about the theoretical point of rotation of the spout D, by which means teeming flow fluctuations during the complete tilting procedure are avoided.

For holding back the slag, for breaking the waves and for absorbing the kinetic energy arising in the ladle by way of the tilting in the vicinity of the spout 21 there is applied a specially formed slag brick 33.

With the described teeming machine practically each and every cast object may be teemed regardless of the height of an associated mould box, since with a model change the electric control means have to be appropriately reprogrammed to match the curves K1 and K2 to the new model.

What is claimed is:

1. A method of controlling the pivoting movement of a teeming ladle about a theoretical fulcrum relative to a teeming funnel of a mold of a substantially linear array thereof and provided in a first teeming machine adapted to be moved in a first direction parallel to the array, the ladle comprising at one side thereof a protruding spout provided with a teeming channel of predetermined radius curved about the fulcrum, comprising the substantially simultaneously executed steps of:

moving the ladle toward the mold in a second direction substantially normal to the first direction for placing the spout over the teeming funnel;

lifting the ladle in a third direction substantially vertically relative to the first and second directions; and pivoting the ladle about an axis intermediate the one side and a side opposite therefrom and extending substantially normal to the second direction.

2. The method of claim 1, wherein the moving, lifting and pivoting movements are executed by motors under preprogrammed electronic control means.

3. The method of claim 2, further comprising a second teeming machine adjacent the first teeming machine for continuing the teeming operation when the ladle of the first teeming machine is empty.

4. A teeming machine, comprising:

a first carriage mounted for movement in a first direction substantially parallel to a linear array of molds;

a second carriage mounted on the first carriage for movement relative to the array of molds in a second direction substantially normal to the first direction;

a structure extending upwardly from the second carriage and supporting retaining means for movement substantially vertically of the first and second directions;

a suspension plate mounted on the retaining means;

means for pivoting the suspension plate about a first axis extending substantially parallel to the movement of the first carriage;

a teeming ladle releasably mounted on the suspension plate and provided with a elongated teeming spout curved about a second axis parallel to the first axis and protruding from the ladle toward the mold;

a means for substantially simultaneously actuating movement of the second carriage in the second direction, actuating the retaining means in a direction substantially vertical to the first and second directions, and actuating the pivoting means.

5. The machine of claim 4, further comprising a first motor for moving the second carriage, a second motor for vertically moving the retaining means and a third motor for pivoting the suspension plate.

6. The machine of claim 5, wherein said means for actuating comprises a programmable electronic control for controlling the movements of the first, second and third motors.

7. The machine of claim 4, further comprising pressure gauges connected to the control means and responsive to changes in the weight of the teeming ladle.

8. The machine of claim 4, wherein the spout of the teeming ladle is provided with an exchangeable spouting stone.

9. The machine of claim 8, wherein the teeming ladle is provided with a slag brick adjacent to the spouting stone.

* * * * *

US006619371C1

(12) EX PARTE REEXAMINATION CERTIFICATE (5743rd)

United States Patent
Lauper

(10) Number: US 6,619,371 C1
(45) Certificate Issued: Apr. 17, 2007

(54) METHOD AND DEVICE FOR CONTROLLING THE MOVEMENT OF THE TEEMING LADLE HAVING A LOW TEEMING HEIGHT IN A TEEMING INSTALLATION DEVICE

(75) Inventor: Fritz Lauper, Wiler bei Seedorf (CH)

(73) Assignee: Hubo Engineering GmbH, Wiler bei Seedorf (CH)

Reexamination Request:
No. 90/007,523, Apr. 26, 2005

Reexamination Certificate for:

| | |
|---|---|
| Patent No.: | **6,619,371** |
| Issued: | **Sep. 16, 2003** |
| Appl. No.: | **09/446,538** |
| Filed: | **Dec. 27, 1999** |

(22) PCT Filed: Jun. 17, 1998

(86) PCT No.: PCT/CH98/00261

§ 371 (c)(1),
(2), (4) Date: Dec. 27, 1999

(87) PCT Pub. No.: WO99/00205

PCT Pub. Date: Jan. 7, 1999

(30) Foreign Application Priority Data

Jun. 27, 1997 (CH) ..... 1554/97

(51) Int. Cl.

| | |
|---|---|
| ***B22D 39/00*** | (2006.01) |
| ***B22D 41/00*** | (2006.01) |
| ***B22D 41/04*** | (2006.01) |

(52) U.S. Cl. ..... 164/136; 164/335; 222/590; 222/599

(58) Field of Classification Search ..... None
See application file for complete search history.

(56) References Cited

U.S. PATENT DOCUMENTS

| | | | |
|---|---|---|---|
| 2,079,872 | A | 5/1937 | Quinn |
| 4,112,998 | A | 9/1978 | Sato |
| 4,155,400 | A | 5/1979 | Rosin et al. |
| 4,304,343 | A | 12/1981 | Bauer et al. |
| 5,170,915 | A | 12/1992 | Szadkowski |
| 5,381,855 | A | 1/1995 | Mezger |
| 5,758,714 | A | 6/1998 | Sato et al. |

FOREIGN PATENT DOCUMENTS

| | | | |
|---|---|---|---|
| DE | 3532763 | A1 | 3/1986 |
| DE | 3610120 | C1 | 4/1987 |
| JP | 04190960 | A | 7/1991 |
| JP | 0506911 | A | 3/1993 |
| JP | 06007919 | A | 1/1994 |
| JP | 008414732 | A | 6/1996 |
| JP | 9-1320 | | 1/1997 |
| JP | 5-329622 | | 12/2000 |

*Primary Examiner*—Kiley Stoner

(57) ABSTRACT

During a casting operation a teeming ladle is moved relatively horizontally in the X direction and vertically in the Z direction and pivoted about rotational axis A. Thus it becomes possible during automatic casting always to maintain the theoretical fulcrum of the spout about which the teeming ladle is pivoted while maintaining a safety margin between the teeming ladle and the mold at the lowest possible position.

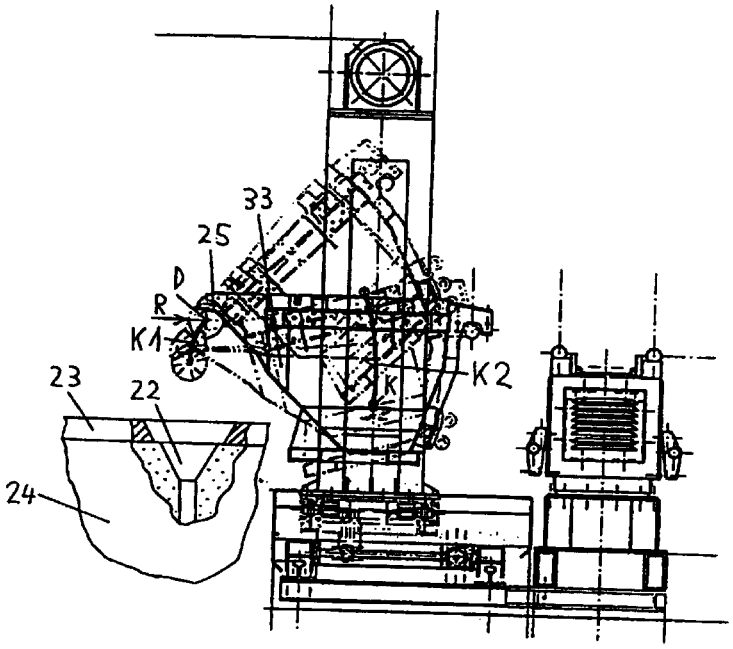

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–9 are cancelled.

* * * * *